US011396719B2

(12) United States Patent
Lin

(10) Patent No.: US 11,396,719 B2
(45) Date of Patent: Jul. 26, 2022

(54) ANTI-CUTTING RUBBER-COATED YARN

(71) Applicant: Huihong (Nantong) Safety Products Co., Ltd., Jiangsu (CN)

(72) Inventor: Xin Lin, Jiangsu (CN)

(73) Assignee: Huihong (Nantong) Safety Products Co., Ltd., Jiangsu (CN)

( * ) Notice: Subject to any disclaimer, the term of this patent is extended or adjusted under 35 U.S.C. 154(b) by 714 days.

(21) Appl. No.: 16/326,704

(22) PCT Filed: Mar. 27, 2018

(86) PCT No.: PCT/CN2018/080641

§ 371 (c)(1),
(2) Date: Feb. 19, 2019

(87) PCT Pub. No.: WO2019/062047

PCT Pub. Date: Apr. 4, 2019

(65) Prior Publication Data

US 2021/0355611 A1 Nov. 18, 2021

(30) Foreign Application Priority Data

Sep. 29, 2017 (CN) ..... 201710907404.2

(51) Int. Cl.

| | |
|---|---|
| ***D02G 3/44*** | (2006.01) |
| ***D06M 15/693*** | (2006.01) |
| ***D02G 3/40*** | (2006.01) |
| *D06M 101/20* | (2006.01) |

(52) U.S. Cl.
CPC ..... *D02G 3/442* (2013.01); *D02G 3/404* (2013.01); *D06M 15/693* (2013.01); *D06M 2101/20* (2013.01)

(58) Field of Classification Search
None
See application file for complete search history.

(56) References Cited

U.S. PATENT DOCUMENTS 6,080,474 A * 6/2000 Oakley ..... D06N 3/14 428/323
2014/0030947 A1* 1/2014 Ardiff ..... D01F 11/08 442/200

FOREIGN PATENT DOCUMENTS

| | | |
|---|---|---|
| CN | 101413211 | 4/2009 |
| CN | 102493202 | 6/2012 |
| CN | 105926104 | 9/2016 |

(Continued)

OTHER PUBLICATIONS

"International Search Report (Form PCT/ISA/210)", dated Jun. 28, 2018, pp. 1-5.

*Primary Examiner* — Shawn McKinnon
(74) *Attorney, Agent, or Firm* — JCIP Global Inc.

(57) ABSTRACT

An anti-cutting rubber-coated yarn includes a yarn body and a mixed rubber layer coated on the yarn body. A plurality of tiny pits is distributed on a surface of the yarn body, and the mixed rubber layer is attached in the tiny pits and is coated on an outside of the yarn body. According to the present invention, numerous tiny pits are made by etching on the surface of the existing yarn body, and simultaneously, molecular bonds on the surface of the yarn body are broken. In a dipping process, molecular bonding occurs between the rubber and the yarn body while the tiny pits are filled with the rubber and the tiny hard particles, thereby further enhancing adsorption fastness of the mixed rubber layer.

7 Claims, 2 Drawing Sheets

(56) References Cited

FOREIGN PATENT DOCUMENTS

| | | |
|---|---|---|
| CN | 206182432 | 5/2017 |
| CN | 107574519 | 1/2018 |
| CN | 207391650 | 5/2018 |
| WO | 9641042 | 12/1996 |

* cited by examiner

ANTI-CUTTING RUBBER-COATED YARN

CROSS-REFERENCE TO RELATED APPLICATION

This is a 371 application of the International PCT application serial no. PCT/CN2018/080641, filed on Mar. 27, 2018 which claims the priority benefits of China Application No. 201710907404.2 filed on Sep. 29, 2017. The entirety of each of the above-mentioned patent applications is hereby incorporated by reference herein and made a part of this specification.

BACKGROUND

Technical Field

The present invention relates to a rubber-coated yarn, and in particular, to an anti-cutting rubber-coated yarn for use in personal protective articles.

Description of Related Art

Most of the existing coated yarns are PE-coated yarns, and have poor cutting resistance when used in gloves. The protection level of the products produced therefrom generally can only reach Level 3 of the American Standard, which cannot be well adapted to the occasions requiring cutting resistance.

In order to improve the cutting resistance level, at present, materials such as glass fiber or steel wire are added to the PE-coated yarn. Since the glass fiber has the defects such as brittleness and hardness, and the particulates generated by the broken glass fiber are easily inhaled into the human body to induce diseases, the glass fiber is gradually not accepted by Europe and other regions. In addition, since the steel wire is hard, the weaving property is poor and it is gradually unpopular.

SUMMARY

An object of the present invention is to provide an anti-cutting coated yarn, in which an anti-cutting layer (a mixed rubber layer) is used to be coated on an outer surface of an existing PE yarn or high-strength polyethylene fiber yarn or other yarn. The anti-cutting layer is firmly attached on a surface of the yarn, so as to improve the anti-cutting level of the yarn without affecting the weaving property of the yarn, such that the anti-cutting level of protective gloves woven from the anti-cutting coated yarn can reach Level 5 of the American Standard. Moreover, the gloves are lightweight and flexible, and protect an operator's hands from the threat of cutting and puncture from work.

The present invention adopts following technical solutions.

An anti-cutting rubber-coated yarn includes a yarn body and a mixed rubber layer coated on the yarn body. A plurality of tiny pits are distributed on a surface of the yarn body, and the mixed rubber layer is attached in the pits and is coated on an outside of the yarn body.

Further, the mixed rubber layer is formed by mixing one of butadiene-acrylonitrile rubber, latex, neoprene rubber, and silica gel, or a mixture thereof in any ratio and a tiny hard particle.

Further, the yarn body is a PE yarn, a PE-coated yarn coated with spandex, a PE-coated yarn coated with nylon, or a PE-coated yarn coated with spandex and nylon.

Preferably, the yarn body is a high-strength polyethylene fiber, a high-strength polyethylene fiber-coated yarn coated with spandex, a high-strength polyethylene fiber-coated yarn coated with nylon, or a high-strength polyethylene fiber-coated yarn coated with spandex and nylon.

Further, the tiny hard particle is one of a metal particle and a stone particle, or a mixture thereof.

Further, the tiny hard particle is one of $SiO_2$ and glass fiber powder, or a mixture thereof in any ratio.

A pigment substance is added to the mixed rubber layer as needed.

A flame retardant substance, a moisture sweat-absorbing substance, a heating substance, or a refrigerating substance, such as carbon black and a self-heating composite material is added to the mixed rubber layer as needed.

Further, a material of the yarn body is HPPE, nylon, dacron, Kevlar, aramid, bamboo fiber, acrylic fiber, or tencel.

According to the present invention, numerous tiny pits are made by etching on the surface of the existing yarn body, and also, molecular bonds on the surface of the yarn body are broken, such that in the dipping process, molecular bonding occurs between the rubber and the yarn body while the pits are filled with the rubber and the tiny hard particles, further enhancing the adsorption fastness of the mixed rubber layer.

DETAILED DESCRIPTION OF THE INVENTION

Figure 1:
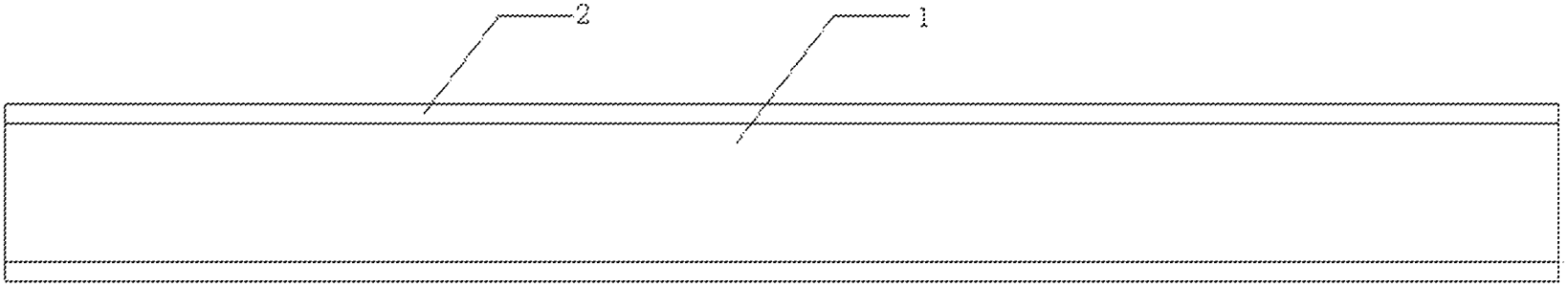
FIG. 1 is a schematic structural diagram of the present invention.
Figure 2:
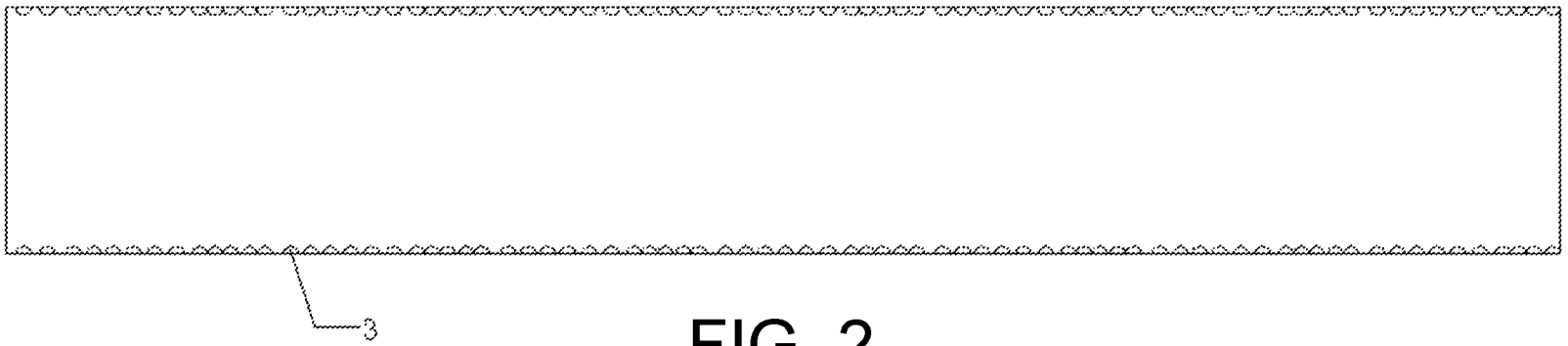
FIG. 2 is a schematic structural diagram of a yarn body of the present invention.
Figure 3:
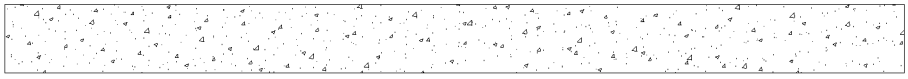
FIG. 3 is a schematic structural diagram of a mixed rubber layer of the present invention.

As shown in FIG. 1 to FIG. 3, an anti-cutting rubber-coated yarn comprises a yarn body and a mixed rubber layer coated on the yarn body. The mixed rubber layer is formed by mixing one of butadiene-acrylonitrile rubber, latex, neoprene rubber, and silica gel, or a mixture thereof in any ratio and tiny hard particles. The tiny hard particle is one of a metal particle and a stone particle, or a mixture thereof. The yarn body is a PE yarn, a PE-coated yarn coated with spandex, a PE-coated yarn coated with nylon, or a PE-coated yarn coated with spandex and nylon.

Numerous irregularly distributed tiny pits are made by etching on a surface of the yarn body, and also, and at the same time, molecular bonds on the surface of the PE yarn are broken, and the mixed rubber layer is attached in the pits and coated on an outside of the yarn body. Since during the rubber coating process, the molecular bonding occurs between the rubber and the PE in the mixed rubber layer, the adsorption force between the mixed rubber layer and the yarn body is further enhanced, and simultaneously the anti-cutting level of the yarn is improved without affecting the weaving property of the yarn, such that the anti-cutting level of protective gloves woven from the anti-cutting coated yarn can reach Level 5 of the American Standard. Moreover, the gloves are lightweight and flexible, and protect an operator's hands from the threat of cutting and puncture from work.

It is noted herein that the tiny hard particle is one of $SiO_2$ and glass fiber powder, or a mixture thereof in any ratio.

Preferably, the yarn body is a high-strength polyethylene fiber, a high-strength polyethylene fiber-coated yarn coated with spandex, a high-strength polyethylene fiber-coated yarn coated with nylon, or a high-strength polyethylene fiber-coated yarn coated with spandex and nylon.

A pigment substance is added to the mixed rubber layer as needed.

A flame retardant substance, a moisture sweat-absorbing substance, a heating substance, or a refrigerating substance, such as carbon black and a self-heating composite material, and so on, is added to the mixed rubber layer as needed.

On the basis of the foregoing technical solution, the material of the yarn body may further be HPPE, nylon, dacron, Kevlar, aramid, bamboo fiber, acrylic fiber, or tencel.

What is claimed is:

1. An anti-cutting rubber-coated yarn, comprising a yarn body and a mixed rubber layer coated on the yarn body, wherein a plurality of tiny pits are distributed on a surface of the yarn body, and the mixed rubber layer is attached in the tiny pits and is coated on an outside of the yarn body, wherein the yarn body is a polyethylene (PE)-coated yarn coated with spandex and nylon.

2. The anti-cutting rubber-coated yarn according to claim 1, wherein the mixed rubber layer covers the PE-coated yarn coated with spandex and nylon is formed by mixing one of butadiene-acrylonitrile rubber, latex, neoprene rubber, and silica gel, or a mixture thereof in any ratio and a tiny hard particle.

3. The anti-cutting rubber-coated yarn according to claim 1, wherein the PE-coated yarn is high-strength polyethylene fiber-coated yarn coated with spandex and nylon.

4. The anti-cutting rubber-coated yarn according to claim 2, wherein a pigment substance is added to the mixed rubber layer as needed.

5. The anti-cutting rubber-coated yarn according to claim 2, wherein a flame retardant substance, a moisture sweat-absorbing substance, a heating substance, or a refrigerating substance is added to the mixed rubber layer as needed.

6. The anti-cutting rubber-coated yarn according to claim 2, wherein the tiny hard particle is one of a metal particle and a stone particle, or a mixture thereof.

7. The anti-cutting rubber-coated yarn according to claim 2, wherein the tiny hard particle is one of $SiO_2$ and glass fiber powder, or a mixture thereof in any ratio.

* * * * *